US011608673B1

(12) United States Patent
Mazur et al.

(10) Patent No.: US 11,608,673 B1
(45) **Date of Patent: *Mar. 21, 2023**

(54) FENESTRATION SYSTEM WITH SHIMMING SEAL

(71) Applicant: WWS Acquisition, LLC, Phoenix, AZ (US)

(72) Inventors: Richard Mazur, Mesa, AZ (US); Cameron Miles Wyatt, Gilbert, AZ (US); Jacob Blackburn, Phoenix, AZ (US); Kraig Hoekstra, Phoenix, AZ (US); James J. Lee, Tempe, AZ (US)

(73) Assignee: WWS Acquisition, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/400,334

(22) Filed: Aug. 12, 2021

Related U.S. Application Data

(63) Continuation of application No. 16/752,517, filed on Jan. 24, 2020, now Pat. No. 11,111,717.

(60) Provisional application No. 62/802,493, filed on Feb. 7, 2019.

(51) Int. Cl.
*E06B 3/00* (2006.01)
*E06B 3/54* (2006.01)
*E06B 3/663* (2006.01)

(52) U.S. Cl.
CPC ..... *E06B 3/5409* (2013.01); *E06B 3/5454* (2013.01); *E06B 3/663* (2013.01)

(58) Field of Classification Search
CPC ..... B32B 17/10302; B32B 17/10055; B32B 17/10036; B32B 17/10064; E06B 3/64; E06B 3/677; E06B 3/6775; E06B 3/5409; E06B 3/5454; E06B 3/663; E06B 1/40; E06B 3/58; E06B 3/66314; E06B 3/66309; E06B 3/24; E06B 3/26303; E06B 3/16; E06B 1/64; Y10T 29/49826
USPC ..... 52/204.593, 204.595, 204.6, 204.591, 52/789.13; 29/428
See application file for complete search history.

(56) References Cited

U.S. PATENT DOCUMENTS 4,064,653 A * 12/1977 Randall ..... E06B 3/26347 49/458
4,390,165 A 6/1983 Murdock
4,624,091 A * 11/1986 Biro ..... E06B 3/5821 52/204.593
4,689,933 A * 9/1987 Biro ..... E06B 3/222 52/204.5
4,742,647 A 5/1988 Pacca
(Continued)

OTHER PUBLICATIONS

Mazur, Richard; Advisory Action for U.S. Appl. No. 16/752,517, filed Jan. 24, 2020, dated Apr. 20, 2021, 11 pgs.
(Continued)

*Primary Examiner* — Chi Q Nguyen
(74) *Attorney, Agent, or Firm* — Taylor English Duma LLP

(57) ABSTRACT

A fenestration system includes a frame defining a sealing slot; a pane assembly assembled with the frame, the pane assembly defining an edge; a gap defined between the frame and the edge; and a fin seal defining a connector portion and a fin portion extending from the connector portion, the connector portion engaging the sealing slot, the fin portion extending across the gap and abutting the edge, the fin portion tapering in thickness between the connector portion and the edge.

26 Claims, 4 Drawing Sheets

(56) References Cited

U.S. PATENT DOCUMENTS

| | | | | |
|---|---|---|---|---|
| 4,753,056 | A | 6/1988 | Pacca | |
| 4,793,107 | A | 12/1988 | Pacca | |
| 5,038,538 | A | 8/1991 | Rozon | |
| 5,446,997 | A * | 9/1995 | Simonton | E06B 3/44 49/458 |
| 5,768,836 | A | 6/1998 | Bachmann | |
| 5,870,859 | A | 2/1999 | Kitada | |
| 7,296,381 | B1 * | 11/2007 | McCabe | E06B 3/5063 49/176 |
| 7,814,711 | B2 | 10/2010 | Milligan et al. | |
| 7,987,633 | B2 * | 8/2011 | Lenox | E06B 3/26303 49/63 |
| 8,341,903 | B2 | 1/2013 | Haab et al. | |
| 8,484,902 | B1 | 7/2013 | Brown et al. | |
| 8,820,721 | B1 | 9/2014 | Poma et al. | |
| 9,127,498 | B1 | 9/2015 | Ye | |
| 9,441,412 | B1 * | 9/2016 | Hooper, Jr | E06B 3/5821 |
| 10,107,027 | B1 * | 10/2018 | Weavers | E06B 3/08 |
| 10,697,170 | B1 | 6/2020 | Mazzola Vernengo | |
| 10,837,219 | B2 * | 11/2020 | Weavers | E06B 3/6715 |
| 10,837,221 | B2 | 11/2020 | Cohen et al. | |
| 11,111,717 | B1 | 9/2021 | Mazur et al. | |
| 2006/0260227 | A1 | 11/2006 | Winfield | |
| 2007/0107331 | A1 * | 5/2007 | Langner | E06B 7/26 52/204.6 |
| 2008/0196342 | A1 * | 8/2008 | Franklin | E06B 3/2675 52/656.5 |
| 2009/0139165 | A1 | 6/2009 | Prete et al. | |
| 2010/0031591 | A1 | 2/2010 | Gallagher | |
| 2013/0000232 | A1 | 1/2013 | Weiss et al. | |
| 2013/0291459 | A1 | 11/2013 | Frey | |
| 2016/0186484 | A1 * | 6/2016 | Nielsen | E06B 3/44 49/458 |
| 2016/0281366 | A1 | 9/2016 | Spence et al. | |
| 2018/0112434 | A1 * | 4/2018 | Sprague | E04F 11/1853 |

OTHER PUBLICATIONS

Mazur, Richard; Final Office Action for U.S. Appl. No. 16/752,517, filed Jan. 24, 2020, dated Feb. 17, 2021, 9 pgs.

Mazur, Richard; Non-Final Office Action for U.S. Appl. No. 16/752,517, filed Jan. 24, 2020, dated Nov. 19, 2020, 10 pgs.

Mazur, Richard; Notice of Allowance for U.S. Appl. No. 16/752,517, filed Jan. 24, 2020, dated May 10, 2021, 10 pgs.

* cited by examiner

FENESTRATION SYSTEM WITH SHIMMING SEAL

CROSS-REFERENCE TO RELATED APPLICATIONS

The present application is a continuation of U.S. application Ser. No. 16/752,517, filed Jan. 24, 2020, which claims priority to U.S. Provisional Application No. 62/802,493, filed Feb. 7, 2019, both of which are hereby specifically incorporated by reference herein in their entireties.

TECHNICAL FIELD

This disclosure relates to fenestration. More specifically, this disclosure relates to a fenestration system comprising a shimming seal.

BACKGROUND

Fenestration includes windows and doors. A fenestration system often comprises a frame and a pane assembly; for example, a glass pane assembly. The glass pane assembly can comprise one or more glass panes. Open gaps between the glass pane assembly and the frame can allow for convection (i.e., heat transfer) from a first side of the fenestration system to a second side; for example, from the outside of a building to the inside of the building.

It is desirable to reduce convection in a fenestration system. Common solutions include filling open gaps with a silicone sealant or a foam material. These processes can be expensive, visually unappealing, and can slow the assembly process. Another common solution is to minimize tolerances between the frame and the glass pane assembly. However, this solution can increase the likelihood of breaking the glass pane(s) during assembly.

It is also desirable to center the glass pane assembly on the frame during assembly of the fenestration system. However, glass pane assemblies often fall away from center when dropped into the frame. Typically, an installer must use a tool, such as a wedge or a shim, to properly center the glass pane assembly on the frame, which can slow down assembly of the fenestration system. The added labor associated with shimming the glass pane assembly into place can also incur undesirable costs.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a fenestration system comprising a frame comprising a first frame side, the first frame side comprising an interior wall, the interior wall defining a sealing slot; and a seal comprising a connector portion engaging the sealing slot and an extension portion extending from the connector portion.

Also disclosed is a fenestration system comprising a frame defining a sealing slot; a pane assembly assembled with the frame, the pane assembly defining an edge; a gap defined between the frame and the edge; and a seal engaging the sealing slot, the seal extending across the gap and abutting the edge.

A method for insulating a fenestration system is also disclosed, the method comprising providing a frame, the frame defining a sealing slot; engaging a seal with the sealing slot; assembling a pane assembly with the frame, wherein a gap is defined between the pane assembly and the frame; and extending the seal across the gap to abut the pane assembly and to divide the gap into an outer gap portion and an inner gap portion.

Disclosed is a fenestration system comprising a frame defining a sealing slot; a pane assembly assembled with the frame, the pane assembly defining an edge; a gap defined between the frame and the edge; and a fin seal defining a connector portion and a fin portion extending from the connector portion, the connector portion engaging the sealing slot, the fin portion extending across the gap and abutting the edge, the fin portion tapering in thickness between the connector portion and the edge.

Also disclosed is a fenestration system comprising: a frame defining a sealing slot; a pane assembly assembled with the frame, the pane assembly defining an edge; a gap defined between the frame and the edge; and a bulb seal defining a connector portion and a bulb portion extending from the connector portion, the connector portion engaging the sealing slot, the bulb portion extending across the gap and abutting the edge; wherein a portion of the bulb portion adjacent to the connector portion defines a thickness that is less than a thickness of the bulb portion distal to the connector portion.

Additionally, disclosed is a fenestration system comprising a frame defining a sealing slot; a pane assembly assembled with the frame, the pane assembly defining an edge; a gap defined between the frame and the edge; and a sweep-type weather stripping defining a connector portion, a fin portion extending from the connector portion, and a pile extending from the connector portion, the pile comprising a plurality of bristles, the connector portion engaging the sealing slot, the bristles extending into the gap and the fin portion extending across the gap and abutting the edge.

A method for insulating a fenestration system, the method comprising: providing a frame, the frame defining a sealing slot; engaging a seal with the sealing slot; assembling a pane assembly with the frame, the pane assembly comprising an outer pane, an inner pane, and a spacer extending between the outer pane and the inner pane, wherein a gap is defined between the spacer and the frame, and wherein the sealing slot is laterally aligned with the spacer; and extending the seal across the gap to directly abut the spacer and to divide the gap into an outer gap portion and an inner gap portion Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
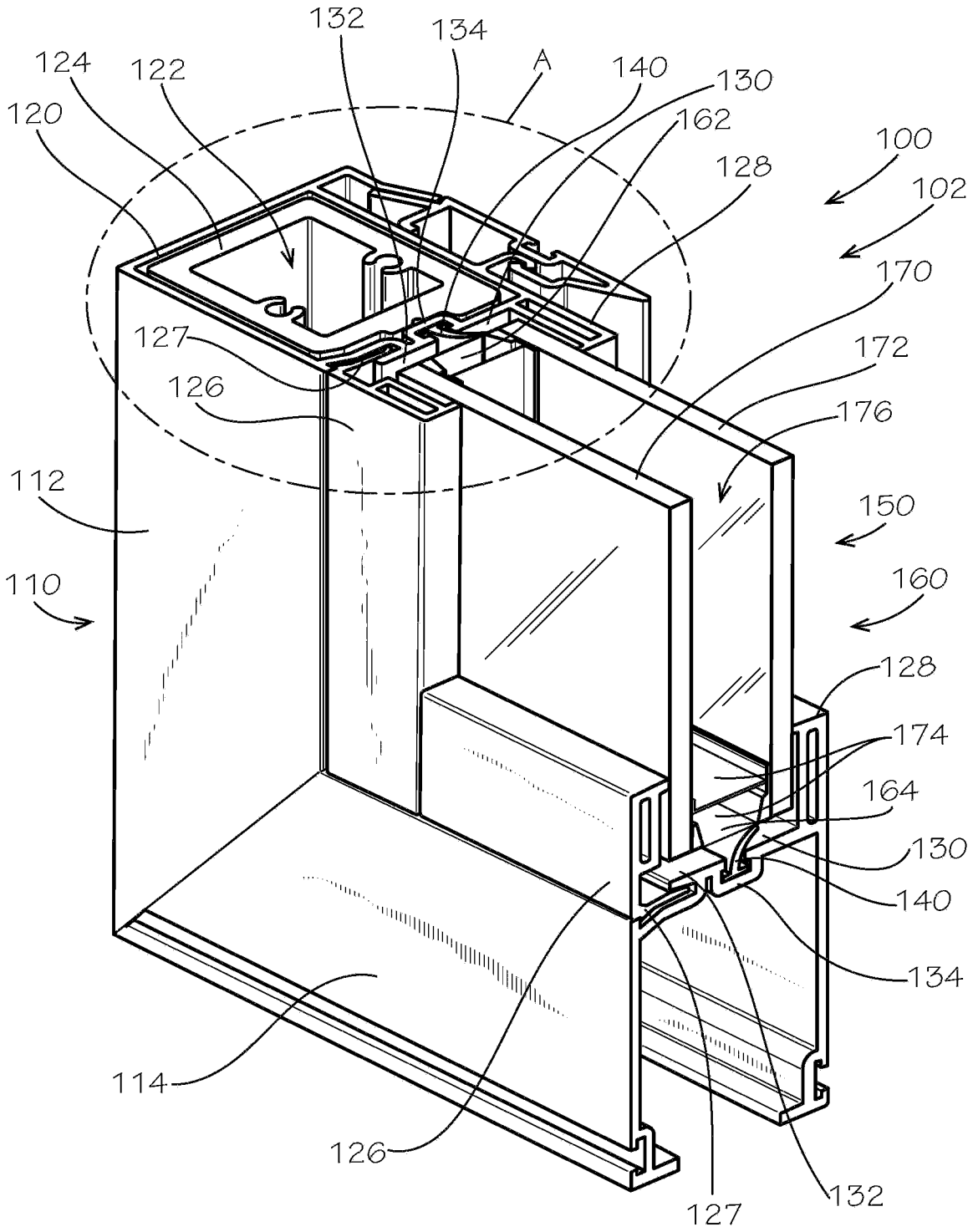
FIG. 1 is a top perspective cutaway view of a bottom left section of a fenestration system, in accordance with one aspect of the present disclosure, wherein the fenestration system comprises a frame and a pane assembly.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a fenestration system and associated methods, systems, devices, and various apparatus. Example aspects of the fenestration system can comprise a frame, a pane assembly, and a seal extending between the frame and the pane assembly. It would be understood by one of skill in the art that the disclosed fenestration system is described in but a few exemplary aspects among many. No particular terminology or description should be considered limiting on the disclosure or the scope of any claims issuing therefrom.

FIG. 1 illustrates a cutaway view of a first aspect of a fenestration system 100 according to the present disclosure. A bottom left section 102, relative to the orientation shown, of the fenestration system 100 is depicted. As shown, the fenestration system 100 can comprise a frame 110 and a pane assembly 150. Example aspects of the pane assembly 150 can be a glass pane assembly and can comprise multiple glass panes, such as an outer pane and an inner pane, which can be rectangular in shape in some aspects. Other aspects of the glass pane(s) can define any other suitable shape, including but not limited to, rounded, triangular, square, and the like. For example, in the present aspect, the glass pane assembly can be an insulating glass unit 160 (IGU) comprising an outer glass pane 170 and an inner glass pane 172. The outer glass pane 170 and inner glass pane 172 be spaced apart by a spacer 174 and can define a space 176 therebetween. The space 176 can be sealed with glazing, which can aid in reducing convection (i.e. heat transfer) across the fenestration system 100.

Example aspects of the insulating glass unit 160 can define a first side edge such as a left side edge 162, an opposite second side edge such a right side edge (not shown), a first end edge such as a bottom end edge 164, and an opposite second end edge such as a top end edge (not shown). Similarly, the frame 110 can define a first frame side such as a left frame side 112, an opposite second frame side such as a right frame side (not shown), a first frame end such as a bottom frame end 114, and an opposite second frame end such as a top frame end (not shown). In the present FIG. 1, the bottom left section 102 of the fenestration system 100 is illustrated, such that portions of the left frame side 112 and bottom frame end 114 of the frame 110 are visible and portions of the left side edge 162 and bottom end edge 164 of the insulating glass unit 160 are visible.

Example aspects of the frame 110 can be formed from aluminum, or can be formed another metal, plastic, wood, or any other suitable material known in the art. Referring to the left frame side 112 of the frame 110, the left frame side 112 can comprise a main frame body 120. The main frame body 120 can define an inner cavity 122 within which a stiffener 124 can be received. In the present aspect, the stiffener 124 can be an aluminum extrusion. In other aspects, the stiffener 124 can be formed from stainless steel, another metal, or any other suitable material for reinforcing the frame 110. Further, the left frame side 112 can comprise a first bracket 126 and a second bracket 128. An interior wall 130 of the left frame side 112 can extend between the first and second brackets 126,128. In the present aspect, the first bracket 126 can be a glazing bead that can be attached to the main frame body 120 by an engagement mechanism 127, and the second bracket 128 can be monolithically formed with the main frame body 120. In other aspects, either or both of the first and second brackets 126,128 can be monolithically formed with the main frame body 120 or can be separately formed from the main frame body 120 and attached thereto. The first and second brackets 126,128 can extend substantially along a length of the main frame body 120 between the bottom frame end 114 and the top frame end. According to example aspects, the left side edge 162 of the insulating glass unit 160 can be clamped between the first bracket 126 and the second bracket 128.

The main frame body 120 of the left frame side 112 can also define a sealing slot 134 formed in an outer surface 132 of the interior wall 130. The sealing slot 134 can extend substantially along a length thereof and can be oriented between the first and second brackets 126,128. In the present aspect, the sealing slot 134 can define a T-shaped cross-section. However, in other aspects the sealing slot 134 can define any other suitable cross-sectional shape. According to example aspects, a seal 140 can be received in the sealing slot 134. The seal 140 can be a fin seal, a wiper seal, a bulb seal, a wedge seal, or any other suitable type of seal or weather stripping known in the art. In the present aspect, the seal 140 can be formed from vinyl. In other aspects, the seal 140 can be formed from rubber (such as EPDM), a thermoplastic elastomer (TPE/TPS), polyvinyl chloride (PVC), foam, felt, or any other suitable material or combination of materials known in the art. Each of the right frame side, top frame end, and bottom frame end 114 can be substantially similar to the left frame side 112, and can define a similar sealing slot 134 and seal 140 received therein. For example, in the present FIG. 1, the sealing slot 134 and seal 140 of the bottom frame end 114 are also visible.

Figure 2:
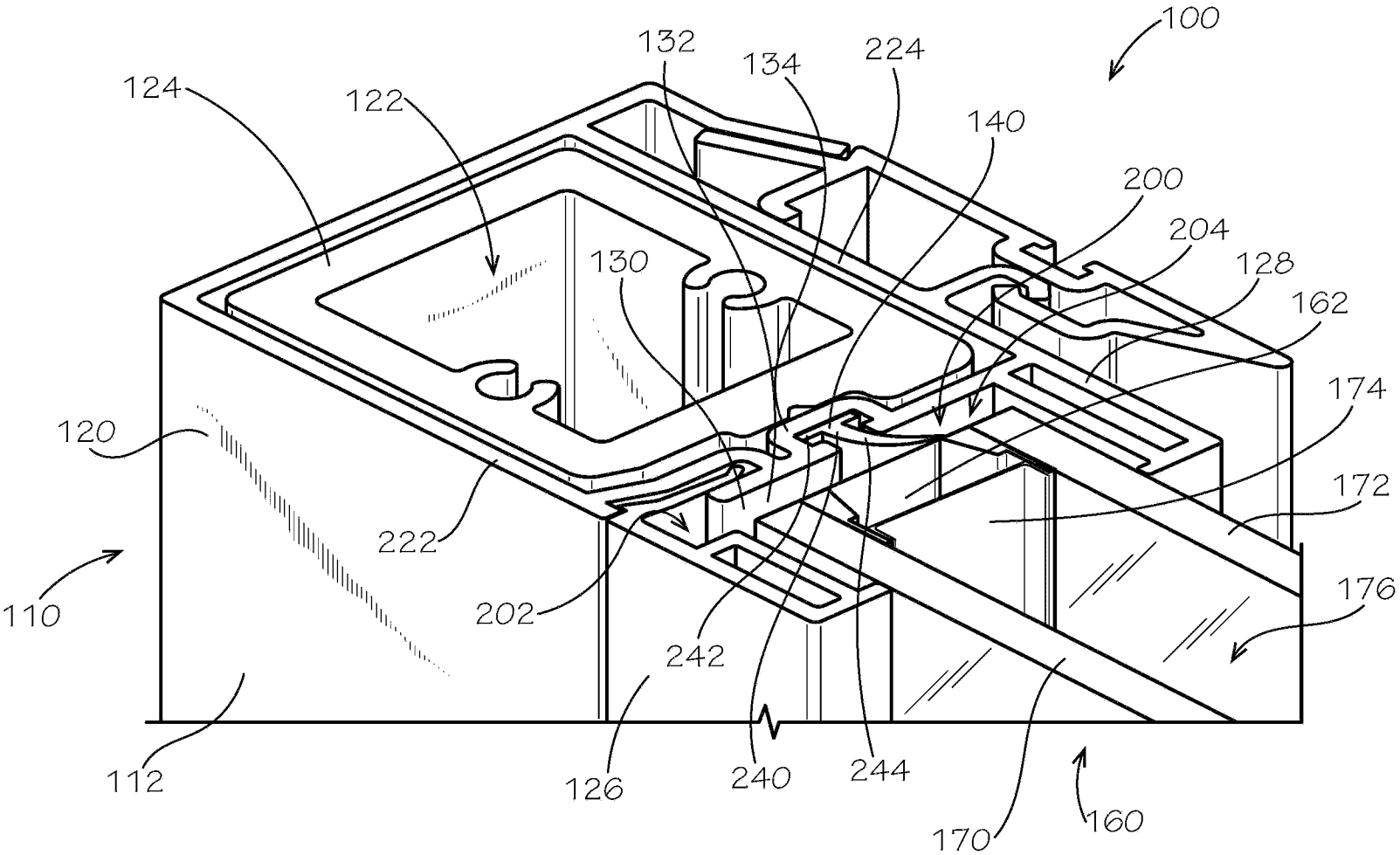
FIG. 2 is a top perspective detail view of Section A of FIG. 1.
Figure 3:
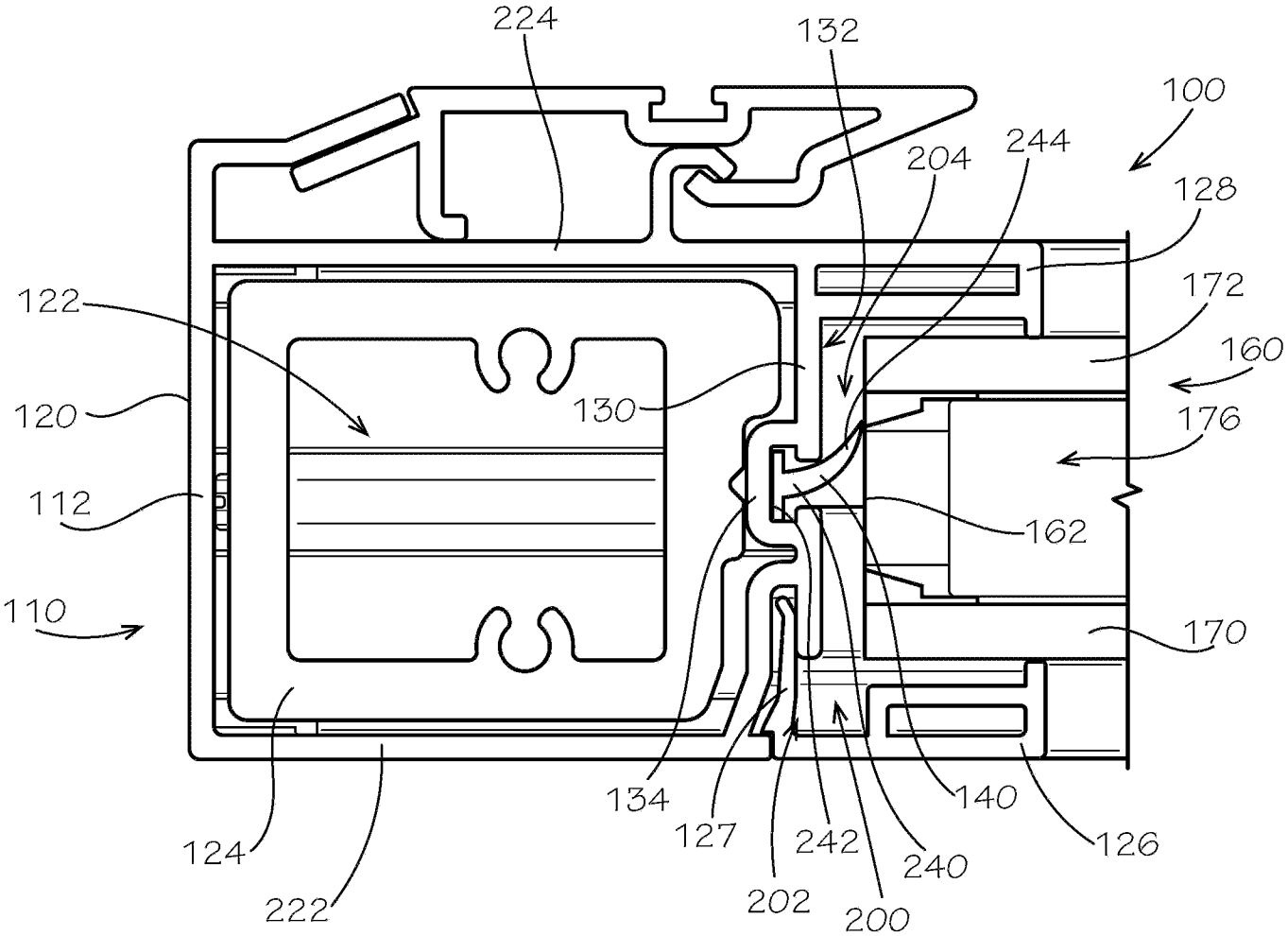
FIG. 3 is a top view of Section A of FIG. 1.

FIGS. 2 and 3 illustrate Section A of FIG. 1, which are detailed top perspective and top views, respectively, of the left frame side 112 of the frame 110 and the left side edge 162 of the insulating glass unit 160 engaged therewith. As shown, when the insulating glass unit 160 is engaged by the first and second brackets 126,128, a gap 200 can be present between the left side edge 162 of the insulating glass unit 160 and the interior wall 130 of the left frame side 112 of the frame 110. The gap 200 can extend between the first and second brackets 126,128, substantially from a front side 222 of the main frame body 120 to a rear side 224 of the main frame body 120.

In the present aspect, the seal 140 can define a connector portion 242 received in the sealing slot 134 and an extension portion extending outwards from the connector portion 242 towards the insulating glass unit 160. The seal 140 can be, for example, a fin seal 240, wherein the extension portion is a fin portion 244. In example aspects, as shown, the fin portion 244 of the fin seal 240 can extend fully across the gap 200 between the interior wall 130 and the insulating glass unit 160 and can touch or abut the pane assembly 150 (e.g., the insulating glass unit 160). In some aspects, the seal 140 can be compressed between the main frame body 120 and the insulating glass unit 160, such that the seal 140 can exert a force on the main frame body 120 and insulating glass unit 160. As such, in some aspects, the seal 140 can comprise a compressible material. In some example aspects, the extension portion (e.g., the fin portion 244) can abut the spacer 174 of pane assembly 150. The seal 140 can also extend substantially along the length of the sealing slot 134, which in some cases can be substantially along the length of the main frame body 120. In other aspects, the seal 140 may not extend fully across the gap 200 and/or fully along the length of the main frame body 120.

According to example aspects, the seal 140 can extend fully across the gap 200 and can abut the pane assembly 150 to divide the gap 200 into an outer gap portion 202 proximate to the outer glass pane 170 and an inner gap portion 204 proximate to the inner glass pane 172. Air received in the outer gap portion 202 can be prevented from entering the inner gap portion 204 by the seal 140, and vice versa. This can provide the benefit of preventing the transfer of hot and/or cold air around the left side edge 162 of the glass panel assembly, thus insulating the fenestration system 100 at the left side edge 162. The seals 140 of the right frame side, top frame end, and bottom frame end 114 can similarly prevent the transfer of hot and/or cold air around the right side edge, top end edge, and bottom end edge 164 of the insulating glass unit 160, respectively. As such, a substantially air-proof seal can be created fully around a perimeter of the insulating glass unit 160 for reducing convection across the fenestration system 100.

According to example aspects, the seals 140 can also serve as shims and can aid in centering the insulating glass unit 160 on the frame 110. Each of the seals 140 of the left frame side 112, right frame side, top frame end, and bottom frame end 114 of the frame 110 can engage the left side edge 162, right side edge, top end edge, and bottom end edge 164 of the insulating glass unit 160, respectively, during assembly of the insulating glass unit 160 with the frame 110 and can aid in retaining the insulating glass unit 160 in the proper centered orientation on the frame 110. As such, providing the seals 140 can reduce or eliminate the need for further shimming to properly center the insulating glass unit 160 on the frame 110, and as such, can provide the advantage of reducing assembly time and labor costs.

Figure 4:
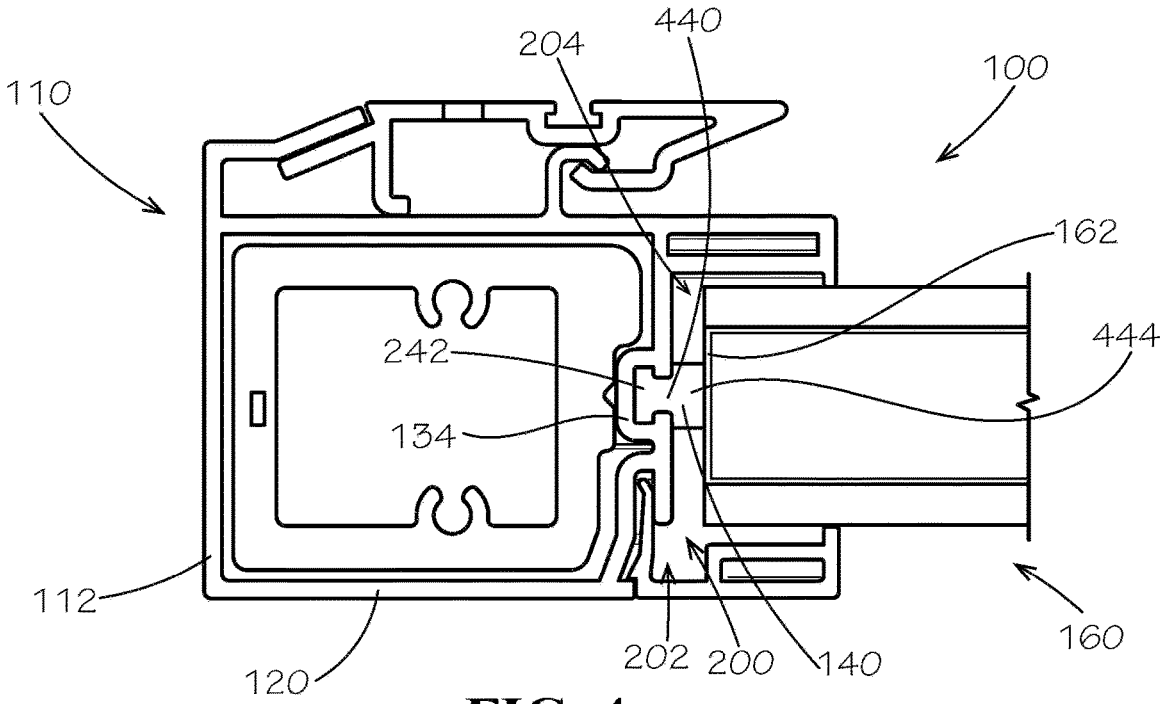
FIG. 4 is a top view of the bottom left section of the fenestration system, according to another aspect of the present disclosure.

FIG. 4 illustrates a cross-sectional view of the fenestration system 100, wherein the seal 140 can be a bulb seal 440. The bulb seal 440 can comprise the connector portion 242 and a bulb portion 444 extending from the connector portion 242.

The connector portion 242 can be received in the sealing slot 134 of the left frame side 112 of the frame 110. As shown, the bulb portion 444 can extend across the gap 200 and can be compressed between the left side edge 162 of the insulating glass unit 160 and the main frame body 120 when the fenestration system 100 is assembled. When compressed, the bulb seal 440 can exert a force against the main frame body 120 of left frame side 112 and the left side edge 162 of the insulating glass unit 160. As described above, the bulb seal 440 can section the gap 200 into the outer gap portion 202 and the inner gap portion 204, and the air received in the outer gap portion 202 can be prevented from entering the inner gap portion 204 by the seal 140, and vice versa.

Figure 5:
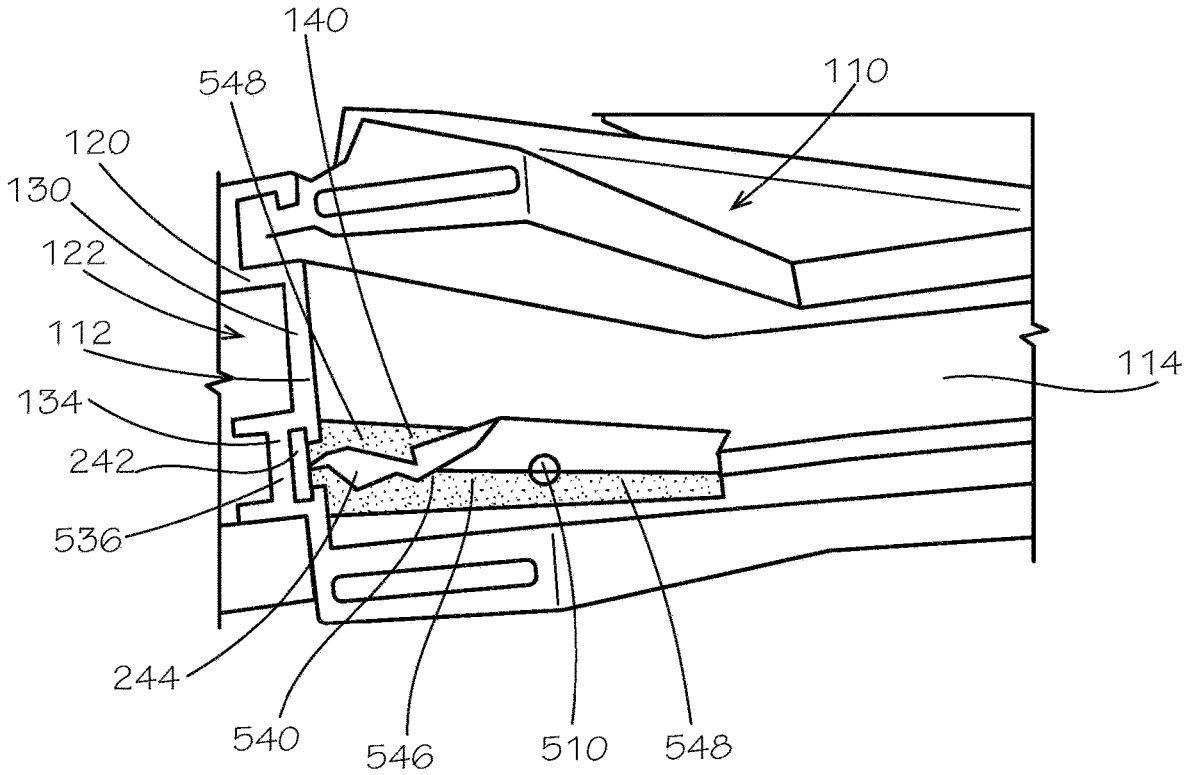
FIG. 5 is a top perspective view of the frame of FIG. 1.

FIG. 5 illustrates a top perspective view of the left frame side 112 and bottom frame end 114 of the frame 110 with the insulating glass unit 160 (shown in FIG. 1) removed. As shown, in the present aspect, the seal 140 can be a sweep-type weather stripping 540 comprising the connector portion 242 engaging the sealing slot 134, the fin portion 244 extending from the connector portion 242, and a pile 546 extending from the connector portion 242. Example aspects of the pile 546 can comprise a plurality of bristles 548, as shown.

Also shown in FIG. 5, one or more fasteners, such as a screw 510, can pierce through the seal 140 and through a back wall 536 of the sealing slot 134, and can engage the stiffener 124 (shown in FIG. 1) received in the inner cavity 122 of the main frame body 120. The screw 510 can hold the stiffener 124 in place within the inner cavity 122 to prevent movement of stiffener 124 therein. Locating the screws 510 or other fasteners on the interior wall 130 of the main frame body 120 can hide the screws 510 from view when the insulating glass unit 160 (shown in FIG. 1) is assembled with the frame 110, which can result in a clean visual appearance. In other aspects, the screw 510 can be engaged with the main frame body 120 and stiffener 124 before the seal 140 is received in the sealing slot 134, such that the screw 510 does not pierce the seal 140. In some aspects, the screw 510 can be self-drilling, obviating the need to pre-drill holes in the seal 140, the back wall 536, or the stiffener 124. In other aspects, holes can be pre-drilled for the screw 510, a nut and bolt, a pin, or any other desired fastener.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A fenestration system comprising:
- a frame defining a sealing slot;
- a pane assembly assembled with the frame, the pane assembly defining an edge;
- a gap defined between the frame and the edge; and
- a fin seal defining a connector portion and a fin portion extending from the connector portion, the connector portion engaging the sealing slot, the fin portion extending across the gap and abutting the edge, the fin portion tapering in thickness between the connector portion and the edge.

2. The fenestration system of claim 1, wherein the frame further comprises a first bracket and a second bracket, the gap extending between the first bracket and the second bracket.

3. The fenestration system of claim 2, wherein:
- the fin seal divides the gap into an outer gap portion and an inner gap portion;
- the outer gap portion is proximate to the first bracket; and
- the inner gap portion is proximate to the second bracket.

4. The fenestration system of claim 3, wherein the fin portion of the fin seal bends towards one of the first bracket and the second bracket.

5. The fenestration system of claim 1, wherein the frame comprises a frame side member, the frame side member defining an interior wall facing the edge of the pane assembly, the sealing slot defined in an outer surface of the interior wall and extending substantially along a length of the interior wall.

6. The fenestration system of claim 5, wherein the interior wall partially defines an inner cavity of the frame and a stiffener is received within the inner cavity.

7. The fenestration system of claim 1, wherein the pane assembly defines an outer pane, an inner pane, and a spacer extending between the outer pane and the inner pane, the sealing slot is laterally aligned with the spacer, and the spacer defines the edge.

8. A fenestration system comprising:
- a frame defining a sealing slot;
- a pane assembly assembled with the frame, the pane assembly defining an edge;
- a gap defined between the frame and the edge; and
- a bulb seal defining a connector portion and a bulb portion extending from the connector portion, the connector portion engaging the sealing slot, the bulb portion extending across the gap and abutting the edge;
- wherein a portion of the bulb portion adjacent to the connector portion defines a first thickness that is less than a second thickness of the bulb portion distal to the connector portion.

9. The fenestration system of claim 8, wherein the frame further comprises a first bracket and a second bracket, the gap extending between the first bracket and the second bracket.

10. The fenestration system of claim 9, wherein:

the bulb seal divides the gap into an outer gap portion and an inner gap portion;

the outer gap portion is proximate to the first bracket; and the inner gap portion is proximate to the second bracket.

11. The fenestration system of claim 8, wherein the frame comprises a frame side member, the frame side member defining an interior wall facing the edge of the pane assembly, the sealing slot defined in an outer surface of the interior wall and extending substantially along a length of the interior wall.

12. The fenestration system of claim 11, wherein the interior wall at least partially defines an inner cavity of the frame and a stiffener is received within the inner cavity.

13. The fenestration system of claim 8, wherein the pane assembly defines an outer pane, an inner pane, and a spacer extending between the outer pane and the inner pane, the sealing slot is laterally aligned with the spacer, and the spacer defines the edge.

14. The fenestration system of claim 13, wherein the bulb portion of the bulb seal is compressed between the frame and the spacer.

15. A fenestration system comprising:

a frame defining a sealing slot;

a pane assembly assembled with the frame, the pane assembly defining an edge;

a gap defined between the frame and the edge; and a sweep-type weather stripping defining a connector portion, a fin portion extending from the connector portion, and a pile extending from the connector portion, the pile comprising a plurality of bristles, the connector portion engaging the sealing slot, the bristles extending into the gap and the fin portion extending across the gap and abutting the edge.

16. The fenestration system of claim 15, wherein the frame further comprises a first bracket and a second bracket, the gap extending between the first bracket and the second bracket.

17. The fenestration system of claim 16, wherein:

the sweep-type weather stripping divides the gap into an outer gap portion and an inner gap portion;

the outer gap portion is proximate to the first bracket; and the inner gap portion is proximate to the second bracket.

18. The fenestration system of claim 15, wherein the frame comprises a frame side member, the frame side member defining an interior wall facing the edge of the pane assembly, the sealing slot defined in an outer surface of the interior wall and extending substantially along a length of the interior wall.

19. The fenestration system of claim 18, wherein the interior wall at least partially defines an inner cavity of the frame and a stiffener is received within the inner cavity.

20. The fenestration system of claim 15, wherein the pane assembly defines an outer pane, an inner pane, and a spacer extending between the outer pane and the inner pane, the sealing slot is laterally aligned with the spacer, and the spacer defines the edge.

21. A method for insulating a fenestration system, the method comprising:

providing a frame, the frame defining a sealing slot;

engaging a seal with the sealing slot;

assembling a pane assembly with the frame, the pane assembly comprising an outer pane, an inner pane, and a spacer extending between the outer pane and the inner pane, wherein a gap is defined between the spacer and the frame, and wherein the sealing slot is laterally aligned with the spacer; and extending the seal across the gap to directly abut the spacer and to divide the gap into an outer gap portion and an inner gap portion.

22. The method of claim 21, wherein:

the seal comprises a connector portion and an extension portion extending from the connector portion; and engaging the seal with the sealing slot comprises engaging the connector portion of the seal with the sealing slot.

23. The method of claim 22, wherein extending the seal across the gap to directly abut the spacer comprises extending the extension portion of the seal across the gap and directly abutting the spacer with the extension portion.

24. The method of claim 22, wherein:

the seal is a fin seal, and the extension portion is a fin portion;

the fin portion tapers in thickness away from the connector portion; and the fin portion is bent against the spacer.

25. The method of claim 22, wherein:

the seal is a bulb seal, and the extension portion is a bulb portion;

a portion of the bulb portion adjacent to the connector portion defines a first thickness that is less than a second thickness of the bulb portion distal to the connector portion; and the bulb portion is compressed between the frame and the spacer.

26. The method of claim 22, wherein:

the seal is a sweep-type weather stripping, and the extension portion is a fin portion;

the sweep-type weather stripping further comprises a plurality of bristles extending from the connector portion; and the plurality of bristles extend into the gap.

* * * * *